United States Patent [19]

Graham

[11] Patent Number: 4,594,066

[45] Date of Patent: Jun. 10, 1986

[54] PRESSURE RELIEF APPARATUS

[75] Inventor: Belvin L. Graham, Astoria, Oreg.

[73] Assignee: Carruthers Equipment Co., Warrenton, Oreg.

[21] Appl. No.: 624,219

[22] Filed: Jun. 25, 1984

[51] Int. Cl.[4] ..... B65B 1/24

[52] U.S. Cl. ..... 425/151; 17/32; 53/122; 53/529; 141/71; 425/345; 425/412

[58] Field of Search ..... 425/136, 149, 150, 153, 425/154, 151, 167, 170, 345, 348, 352, 353, 434, 435, 412, 135; 100/53; 264/40.1, 40.5, 40.7; 91/509, 511, 525; 92/62, 129; 141/71, 73; 17/32; 53/122, 529

[56] References Cited

U.S. PATENT DOCUMENTS

| | | | |
|---|---|---|---|
| 1,115,605 | 11/1914 | Snohr | 91/525 |
| 3,112,521 | 12/1963 | Ward | 264/40.5 |
| 3,303,537 | 2/1967 | Mislan | 264/40.5 |
| 3,346,403 | 10/1967 | Carruthers | 141/1 |
| 3,555,605 | 1/1971 | Angelotti et al. | 425/197 |
| 3,792,134 | 2/1974 | Paulson | 264/40.7 |
| 3,999,477 | 12/1976 | Good et al. | 425/153 |
| 4,070,946 | 1/1978 | Sandvik et al. | 92/129 |
| 4,161,140 | 7/1979 | Altman | 425/153 |
| 4,201,238 | 5/1980 | Baugh | 92/62 |
| 4,330,252 | 5/1982 | Bullock | 425/412 |
| 4,499,821 | 2/1985 | Clouston | 100/269 R |

*Primary Examiner*—Jay H. Woo
*Assistant Examiner*—J. Fortenberry
*Attorney, Agent, or Firm*—Kolisch, Hartwell & Dickinson

[57] ABSTRACT

The present invention provides a food packing machine which includes the following components: a piston mounted for reciprocation during an operating cycle between a pair of limit positions toward and away from a cake forming cavity, for compressing food material in the cavity; bias apparatus for exerting pressure on the piston to provide compression pressure on the material, the bias apparatus including a resilient material mounted to the piston, and a seat to which the resilient material is also mounted to effect a resilient mounting between the piston and the seat; and pressure relief apparatus for selectively urging the set away from the piston to reduce the bias thereon upon reception of a predetermined signal. The machine normally also includes a sensor for sensing when the machine is deactivated, and a signal device for providing the signal to the pressure relief apparatus when the sensor determines that the machine is deactivated. This prevents over-compaction or over-drainage of the food product being packed when the machine must be stopped during an operating cycle.

11 Claims, 8 Drawing Figures

PRESSURE RELIEF APPARATUS

BACKGROUND OF THE INVENTION

This invention relates to pressure relief apparatus which is usable with food packing machinery to relieve packing compression when such machinery is stopped. While the mechanism of the present invention is applicable to machines designed for the packing of a wide variety of food products such as meats and vegetables, the mechanism is herein described in conjunction with a machine for packing tuna in so-called "chunk" or "flake" packs, an application with which this invention has been found to have particular utility.

To explain the environment and operation of a conventional tuna packing machine, reference is made to U.S. Pat. Nos. 4,330,252 and 3,346,403. The disclosures of such patents are incorporated herein by reference to illustrate conventional packing machine construction. In such machines, tuna in flake or chunk condition is fed into the machine and is directed into cylindrical cavities which continuously move through a path of travel. Pressure is applied to the product subsequent to the cavity-filling operation to fill voids, expel air, and to ensure a substantial and uniform pack of tuna in the cavities. After application of pressure, the resulting cake of tuna is trimmed to bring the amount which is to be canned to a predetermined weight. The compressed tuna cake is then transferred to a can or other container.

The pressure application process is critical because it determines the amount of tuna meat which will be packed into the predetermined volume. It also determines the moisture content of the resulting tuna cake. During automated operation of the tuna packing equipment, it may be necessary at certain times to stop the machinery while compression is taking place. Because the density of the tuna cake increases with time as compression is held constant, stopping the machine while it is in the compression mode will result in over-compression of the cake, which causes an excess amount of fluid to be compressed out of the tuna.

For these reasons, I determined it to be desirable to develop means for relieving compression when food product packing machinery must be stopped during production. It was therefore a general object of the present invention to develop such apparatus which is usable with conventional automated equipment designed to pack tuna and other meat and vegetable products. An additional object is that the apparatus should be simple in construction and therefore inexpensive to purchase, operate and maintain.

SUMMARY OF THE INVENTION

The present invention achieves the above-identified objects by providing a food packing machine which includes the following components: a piston mounted for reciprocation during an operating cycle between a pair of limit positions toward and away from a cake forming cavity, for compressing food material in the cavity; biasing means for exerting pressure on the piston to provide compression pressure on the material, the biasing means including resilient means mounted to the piston, and a seat to which the resilient means is also mounted to effect a resilient mounting between the piston and the seat; and pressure relief means for selectively urging the seat away from the piston to reduce the bias thereon upon reception of a predetermined signal. The term "reduce" is used herein in the broad sense to cover not only a reduction in the bias, but also a total elimination of that bias.

The machine normally also includes a sensor for sensing when the machine is deactivated. By reducing the compression bias when the machine is deactivated, and a signaling means for providing the signal to the pressure relief apparatus when the sensor determines that the machine is deactivated. By reducing the compression bias when the machine is stopped, the food product which is being packed will not be overly compressed which could otherwise result in excessive drainage of fluid from the food, over-compaction, or other deleterious effects.

These and other features, objects and advantages of the present invention will become further apparent as this description continues.

DETAILED DESCRIPTION OF A PREFERRED EMBODIMENT

Figure 1:
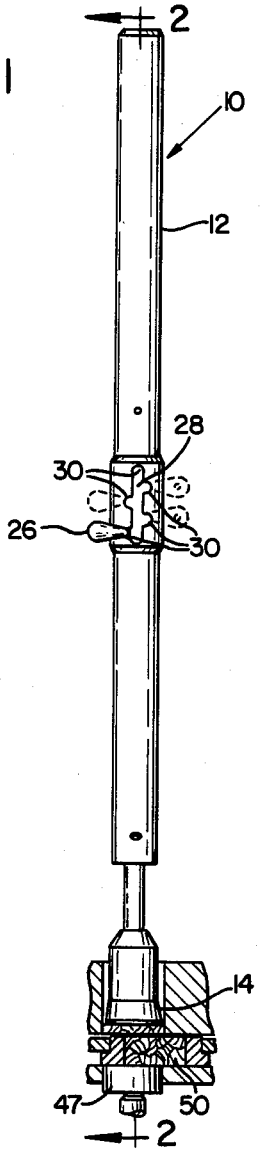
FIG. 1 is a front elevation view of a portion of a packing machine with which this invention may be utilized, showing the piston in a pressure-applied position with the packed food product being conveyed away.
Figure 2:
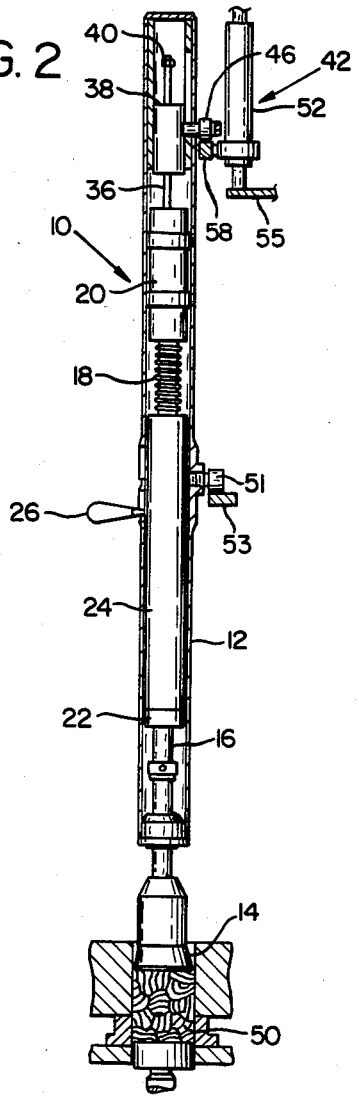
FIG. 2 is a side elevation sectional view along line 2—2 of FIG. 1, also showing a first embodiment of the pressure relief apparatus of the present invention except that the piston has only begun to apply compression pressure.

FIGS. 1 and 2 depict a conventional compression piston with which the present invention may be utilized. However, it should be understood that the invention is suitable for operation with a wide variety of other types of compression machines. To understand the environment of the present invention, the depicted compression piston will first be described.

A single compression piston apparatus has been identified in the Figures with the numeral 10. The apparatus 10 includes a cylindrical outer casing 12, a piston head 14, a piston rod 16, a compression spring 18 which encompasses the piston rod within the outer casing, an upper spring seat 20 which receives and engages the upper end of the compression spring, a lower spring seat 22 which receives and engages a lower end of the compression spring, and a spring casing 24 which surrounds most of the length of the compression spring. A compression range adjustment handle 26 is threaded into spring casing 24 and extends through a slot 28 defined in the side of outer casing 12. Slot 28 includes five different detent positions 30 which permit compression range adjustment handle 26 to be disposed at various heights, thereby permitting the degree of compression to be manually adjusted.

Figure 5:
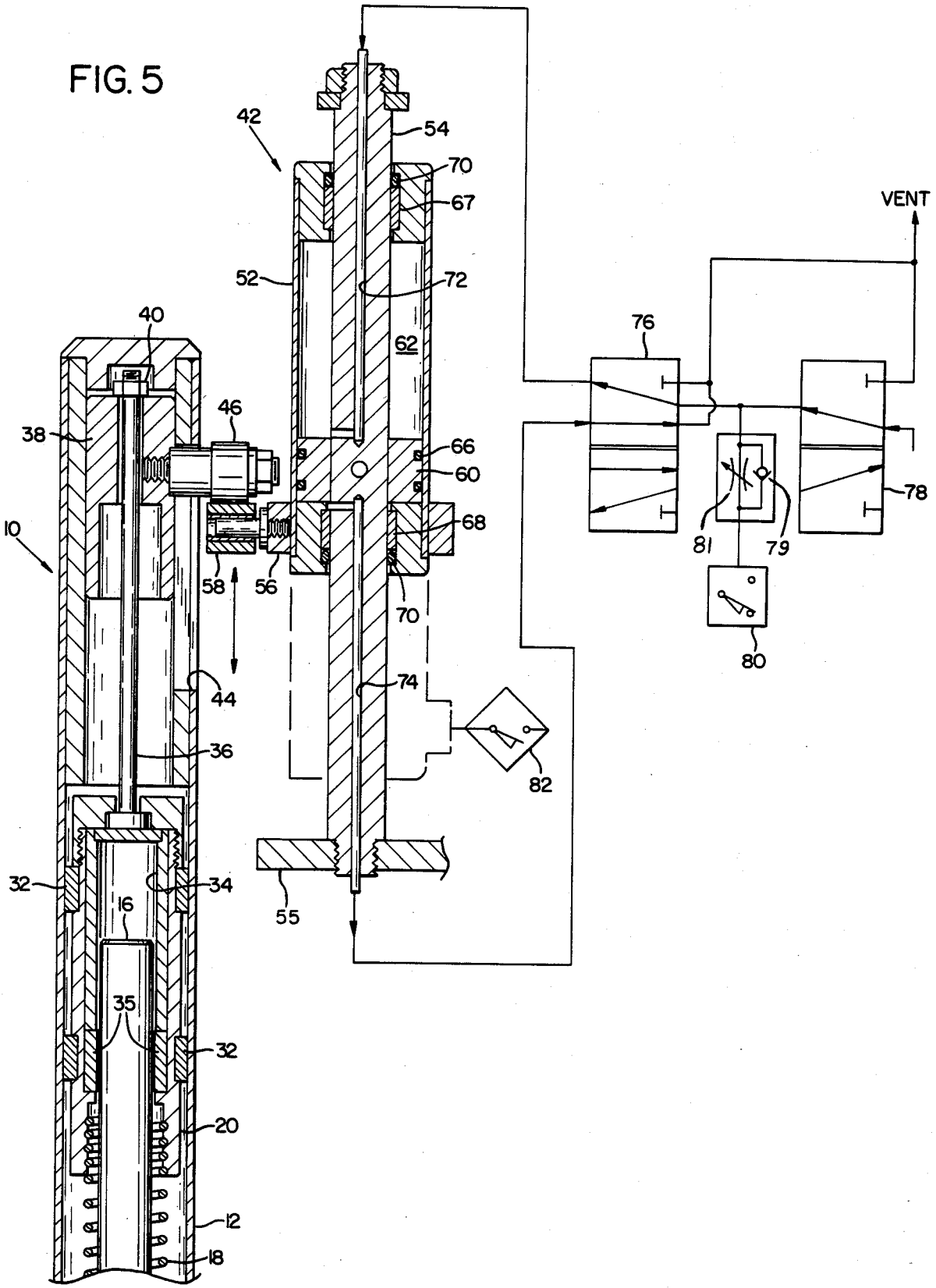
FIG. 5 is an enlarged side elevation sectional view generally corresponding to the view of FIG. 2, showing the compression relief apparatus in its raised or activated position, with portions broken away to show detail, along with the controls to such apparatus.
Figure 6:
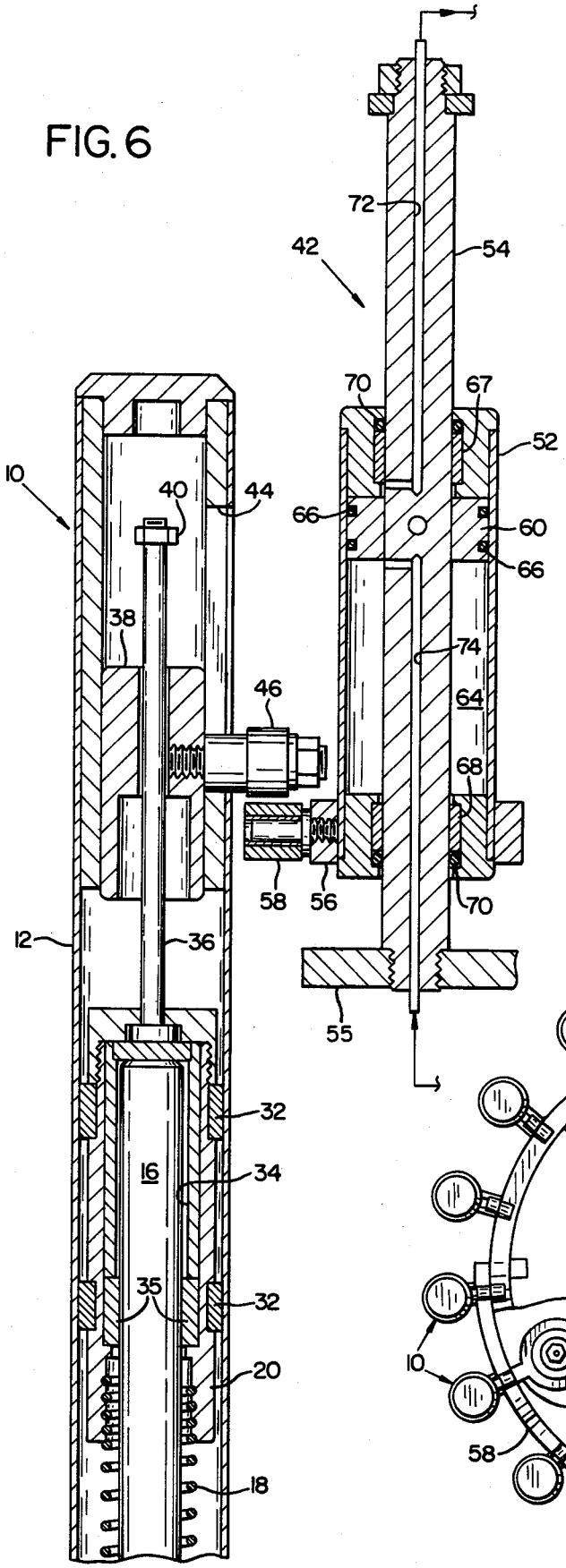
FIG. 6 is a view corresponding to that of FIG. 5 except that the compression relief apparatus is shown in its lowered or inactive position.

As shown in FIGS. 5 and 6, upper spring seat 20 is generally cylindrical in configuration and includes a pair of spring seat rings 32 which adapt the upper spring seat to reciprocate upwardly and downwardly within outer casing 12. Upper spring seat 20 also includes a cylindrical bore 34 which receives the upper end of piston rod 16, thereby permitting relative reciprocation between the upper spring seat and the piston rod, as can be seen by comparing FIGS. 5 and 6. A single piston rod guide ring 35 is mounted to upper spring seat 20 within bore 34 to provide further guidance to the reciprocation of piston rod 16 within the upper spring seat.

An upper extension rod 36 is affixed to and extends from the upper end of upper spring seat 20, and passes through a cylindrical compression relief plunger 38. This plunger 38 will sometimes be referred to herein as reciprocable member. A stop such as nut 40 is disposed at the upper end of upper extension rod 36 to provide an abutment shoulder against which the upper end of compression relief plunger 38 comes into contact when the compression relief apparatus, identified generally with the numeral 42, shifts to its compression relief position depicted in FIG. 5. Extending outwardly through a slot 44 in outer casing 12 is a cam follower 46 which is threadably engaged by compression relief plunger 38.

Figure 8:
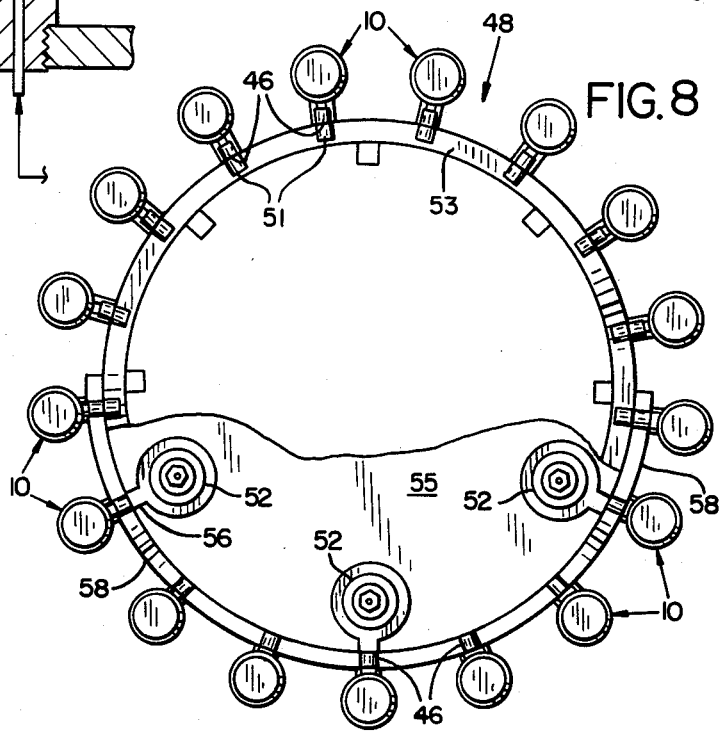
FIG. 8 is a schematic, top plan elevation view showing a turret mounting a plurality of circumferentially disposed packing pistons, along with the substantially semi-circular compression relief cam of the preferred embodiment.

As seen in FIG. 8, a plurality of the described compression piston apparatuses 10 are normally circumferentially mounted in a rotatable turret 48 to provide for the automated packing of tuna, salmon, and a wide variety of other food products. As described in prior U.S. Pat. Nos. 4,330,252 and 3,346,403, each of the compression piston apparatuses is cam-driven toward and away from an associated cake forming cavity such as those shown at 50 in FIGS. 1–4. A main cam follower 51 is threaded into outer casing 12 to connect each of the apparatuses 10 to an appropriate cam drive such as provided by a circular main control cam 53.

This cam 53 has been depicted in FIGS. 2 and 8 for purposes of simplification as a simple flat surface. It would actually comprise a groove in the periphery of a thicker surface so that both upward and downward motion could be conveyed to follower 51. Operation of the compression piston apparatus 10 and piston head 14, as the latter moves initially into a cavity 50, is characterized by nonyieldable biasing, or driving, of the piston head into the cavity. In essence, the piston head 14 and the compression piston apparatus 10, which are relatively reciprocable, bottom out against one another to define one limit position of movement of the piston head relative to the compression piston apparatus—with cam drive then imparted directly to the piston head independent of any spring biasing action. Immediately thereafter, that is, after piston head 14 has been driven into the cavity 50, compression spring 18 takes over the piston drive functions, and promotes continued, but now yieldable, driving of the piston head into the cavity.

The compression relief apparatus 42 will now be described. The compression relief apparatus includes a plurality of compression relief cylinders 52, here three each of which is mounted to reciprocate along a compression relief rod 54, which are mounted to a stationary turret table 55. These three compression relief cylinders 52 and rods 54 are evenly spaced about one side of turret 48 as shown in FIG. 8. The lower end of each compression relief cylinder 52 is affixed by a cam mounting member 56 to a substantially semicircular compression relief cam 58. This cam 58 is circumferentially mounted around turret 48 to engage each of the cam followers 46 of the compression relief apparatus 10 disposed on that side of the turret.

Each compression relief cylinder 52 is mounted to reciprocate upwardly and downwardly along its respective stationary compression relief rod 54. Each rod 54 has centrally mounted to it a stationary wall 60 which defines upper and lower chambers 62 and 64 within compression relief cylinder 52. A pair of O-rings 66 encompass wall 60 to prevent leakage between these chambers 62 and 64. Compression relief cylinder 52 includes an upper and lower guide ring 67 and 68 to guide the reciprocation of the cylinder along compression relief rod 54. An O-ring 70 is also provided adjacent each guide ring to prevent leakage out of the cylinder. A first fluid supply channel 72 extends axially through the upper portion of compression relief rod 54 and then radially out of the rod adjacent wall 60, thereby interconnecting the fluid control means with upper chamber 62. A second fluid supply channel 74 similarly extends through the lower portion of compression relief rod 54, and then emerges radially into lower chamber 64, adjacent the underside of wall 60. Thus, any pressure differential existing across wall 60 will exert upward or downward forces upon compression relief cylinder 52.

The control system for compression relief apparatus 42 will now be described. It is normally possible to control and drive the apparatus using pneumatic pressure, although it may be desirable on certain applications to use hydraulic pressure. Making reference to the schematic depiction in FIG. 5, a 4-way solenoid 76 provides a fluid connection to both upper and lower chambers 62 and 64, and when energized as depicted in FIG. 5, applies fluid pressure to upper chamber 62 and permits lower chamber 64 to exhaust. This causes compression relief cylinder 52 to raise to the position depicted. When solenoid 76 is de-energized, the opposite occurs; that is, upper chamber 62 is exhausted and lower chamber 64 is provided with pressurized fluid, thereby causing compression relief cylinder 52 to shift downwardly.

A 3-way solenoid 78 is energized only when the packing machine is stopped, such as when it enters an emergency shutdown mode or when it is manually stopped. At that time, solenoid 78 supplies fluid pressure to solenoid 76 and to a delay relay 80. Relay 80 is a fixed range pressure switch, and works in cooperation with a free reverse flow check valve 79 which is mounted variable orifice 81. The contacts of delay relay 80 are normally open, but are designed to close approximately 2.5 seconds after solenoid 78 is energized, which is the period it will take a volume of air to pass through variable orifice 81. This allows time for turret 48 to actually stop before the compression relief cylinders 52 begin to raise compression relief cam 58.

A limit switch 82 positioned at the lower end of travel of one of the compression relief cylinders 52 closes only when the cylinders are at the bottom of their travel. The packing machine will not run until limit switch 82 is closed, thereby indicating that compression relief cam 58 is in its lowered, inactive position.

Figure 7:
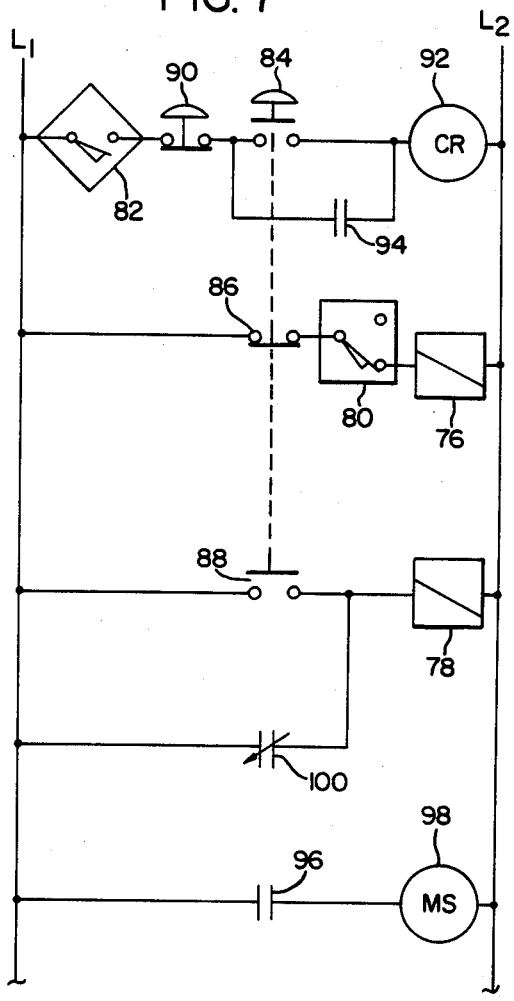
FIG. 7 is a schematic diagram of the electrical controls of the system of FIG. 5.

FIG. 7 schematically depicts further controls for the packing machine and the compression relief apparatus 42. The controls include a start button 84 which is mechanically connected to a normally closed contact 86 and a normally opened contact 88. Contact 86 is in series with 4-way solenoid 76 and delay relay 80, while contact 88 is in series with 3-way switch 78. Limit switch 82 is in series with start button 84, a stop button 90, and a control relay 92. A second control relay contact 94 is provided in parallel with start button contact 84. Contact 94 is electrically connected to another contact 96 in another parallel circuit which includes a motor starter relay 98 which controls the operation of the packing machine. Contact 100 is also interconnected with contacts 94 and 96 to open when they both close, thereby controlling the operation of solenoid 78.

OPERATIONAL DESCIPTION

The operation of the depicted embodiment will now be described. Start button 84 may be depressed regardless of the initial position of compression relief cylinders 52. Depression of start button 84 automatically opens contact 86 which de-energizes solenoid 76, thereby exhausting upper chamber 62 and sending fluid pressure to lower chamber 64. This causes compression relief cylinders 52 to shift to their lowered position depicted in FIG. 6, displacing compression relief cam 58 and compression relief plungers 38 of each compression piston apparatus 10 to their lowered positions. The reduction of pressure in upper chamber 62 causes air pressure in delay relay 80 to bleed through check valve 79, this opening the delay relay. With compression relief apparatus in this inactive mode, it does not affect the operation of the packing machine.

When compression relief cylinders 52 reach the bottom of their travel, they cause limit switch 82 to close, which allows control relay 92 to energize, also energizing relays 94 and 96, sending power to motor starter relay 98. This starts the packing machine. Relay 100 is simultaneously opened, which causes solenoid 78 to de-energize when the start button 84 is released and contact 88 is opened.

Once the packing machine is started, it operates just as though the compression relief apparatus 42 was not included. Thus, the various compression piston apparatuses 10 will reciprocate upwardly and downwardly to pack tuna or other food product into their respective cavities 50.

Figure 3:
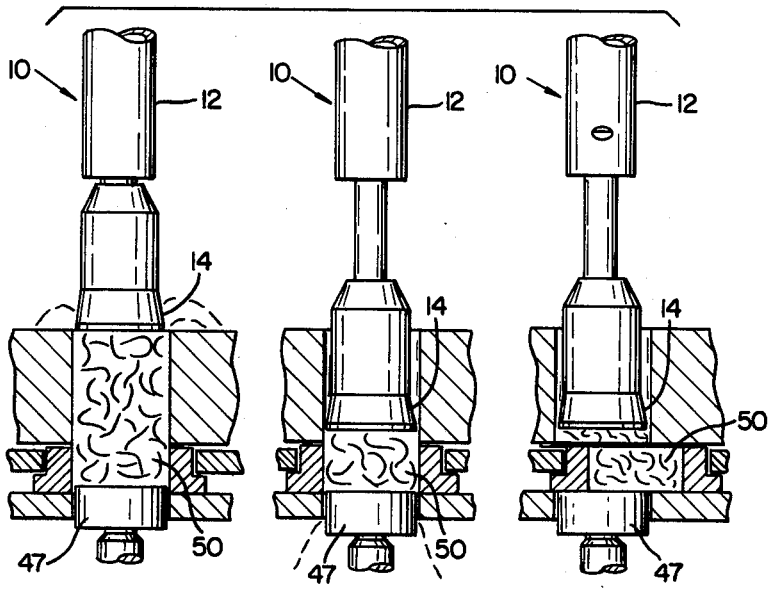
FIG. 3 is a schematic, fragmentary elevation view showing three different phases of the packing cycle.

The normal operating cycle of the packing machine and its piston 14 is depicted in FIG. 3. The left-most view shows piston 14 just prior to the initiation of compression, with cavity 50 full of food product, such as tuna, to be packed. The center view of FIG. 3 illustrates piston 14 most of the way through its compression cycle, showing excess fluid drainage from cavity 50. The right-most view shows compression completed, after a knife has cut the packed portion, with the pack being conveyed away.

If the packing machine must be stopped, stop button 90 is depressed, which resets and de-energizes control relay 92, changing the state of all three control relay contacts 94, 96 and 100. The opening of relay 96 cuts power to the packing machine motor, thereby stopping the machine. Simultaneous closing of relay 100 energizes solenoid 78, which applies pneumatic pressure to the input of solenoid 76 and delay relay 80. Then, 2.5 seconds after the stop button 90 is pushed, which gives the packing machine time to actually stop dead, delay relay 80 closes and solenoid 76 is energized, thereby applying fluid pressure to upper chamber 62 and exhausting lower chamber 64, causing compression relief cylinder 52 to shift upwardly. Compression relief cam 58 thus raises each of the compression relief plungers 38 of those compression piston apparatuses 10 which are disposed on the side of the packing machine in which compression is taking place; that is, the lower portion of turret 48 as depicted in FIG. 8. Each of the compression relief plungers 38 is elevated freely until it comes into abutment with stop nut 40, at which point upper extension rod 36 and upper spring seat 20 mounted thereto are also elevated. This dramatically reduces the pressure which compression spring 18 is exerting on cavity 50, which prevents over-compression of the tuna or other food product being compressed therein. Thus, the momentary or prolonged stopping of the packing machine will not result in over compaction or over drainage of the food product.

Figure 4:
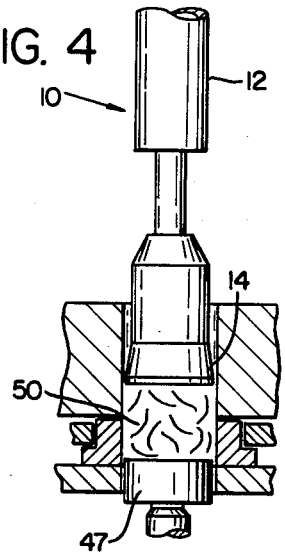
FIG. 4 is a view corresponding to the views of FIG. 3 except that the packing piston is shown in its compression-relieved position as it would appear if the machine was deactivated when the piston was halfway through its compression stroke.

FIG. 4 depicts piston 14 as it would normally be positioned after compression relief, if the machine was deactivated mid-way through a compression stroke. Compression relief will normally not result in actual withdrawal or upward displacement of piston 14. However, in some applications, such as where extremely resilient food products are being packed, such displacement might occur.

In order to restart the machine, start button 84 is merely depressed.

Changes and modifications can be made to the preferred embodiment without departing from the spirit and scope of the present invention and without diminishing its attendant advantages. It is, therefore, intended that such changes and modifications be covered by the following claims.

It is claimed and desired to secure by letters patent:

1. A food packing machine having a cake forming cavity comprising:

a piston mounted for reciprocation toward and away from an entrance to the cavity to apply pressure to the material in the cavity;

spring-biasing means mounted to said piston so that at least a portion of the reciprocation of said piston is spring-biased;

pressure relief means including a plunger mounted to said spring-biasing means to be selectively displaced away from said piston for reducing the spring-biasing force applied to the piston and thereby reduce the piston-applied pressure on the cavity upon reception of a deactivation signal, without requiring displacement of said piston;

sensing means for sensing when the machine is deactivated; and signaling means for providing the signal to said pressure relief means when said sensing means determines that the machine is deactivated.

2. The apparatus of claim 1, further comprising means for automatically deactivating said pressure relief means when the machine is re-started.

3. The apparatus of claim 1 wherein said signaling means includes delay means for delaying the signal to said pressure releif means until the machine is stopped.

4. The apparatus of claim 3 wherein said delay means comprises pressure sensing means and flow restriction means through which pneumatic pressure passes for a predetermined delay period.

5. The apparatus of claim 1 wherein said signaling means sends fluid pressure to said pressure relief means to reduce compression pressure of said piston when said sensing means senses that the machine is deactivated.

6. The machine of claim 1 wherein a plurality of said pistons are included, and said pressure relief means includes means for simultaneously reducing the bias on all said pistons.

7. The food packing machine of claim 1, wherein said spring-biasing means includes:

a spring having upper and lower ends;

an upper spring seat which engages said upper spring end; and mounting means controllably mounting said plunger to said upper spring seat so that displacement of said plunger away from said piston causes, during at least a portion of said displacement, said upper spring seat and said upper spring end to be displaced away from said piston.

8. The food packing machine of claim 7, wherein said mounting means includes slide means for permitting a predetermined amount of relative movement between said piston and said plunger so that piston-applied pressure is independent of the motion of said plunger for at least a portion of the operating cycle.

9. The food packing machine of claim 8, wherein said slide means includes a rod extending from said upper spring seat in a direction away from said piston, said rod including stop means spaced from said upper spring seat, and wherein said plunger is slidably disposed on said rod between said upper spring seat and said stop means so that during at least a portion of its displacement said plunger can move freely along said rod without displacement of said upper spring seat, but when said plunger is displaced away from said upper spring seat to an extent that said stop means is contacted, any further displacement of said plunger away from said piston displaces said upper spring seat away from piston, thereby reducing the spring biasing on said piston to reduce the piston-applied pressure on the cavity.

10. A food packing machine having a cake forming cavity comprising:

a piston mounted for reciprocation toward and away from an entrance to the cavity to apply pressure to the material in the cavity;

spring-biasing means mounted to said piston so that at least a portion of the reciprocation of said piston is spring-biased, said spring-biasing means including a spring having upper and lower ends, and an upper spring seat which engages said upper spring end;

pressure releif means including a plunger mounted to said upper spring seat to be selectively displaced away from said piston for reducing the spring-biasing force applied to the piston and thereby reduce the piston-applied pressure on the cavity upon reception of a deactivation signal;

sensing means for sensing when the machine is deactivated; and signaling means for providing the signal to said pressure relief means when said sensing means determines that the machine is deactivated.

11. The apparatus of claim 10 wherein said pressure releif means includes means for reducing the spring biasing without necessarily causing displacement of said piston.

* * * * *